US005466551A

United States Patent [19]

Yuh et al.

[11] Patent Number: 5,466,551

[45] Date of Patent: Nov. 14, 1995

[54] IMAGE MEMBER INCLUDING A GROUNDING LAYER

[75] Inventors: Huoy-Jen Yuh, Pittsford; John W. Spiewak; Christine J. Tarnawskyj, both of Webster; Steven J. Grammatica, Penfield; Cindy C. Chen, Rochester; Leon A. Teuscher, Webster, all of N.Y.

[73] Assignee: Xerox Corporation, Stamford, Conn.

[21] Appl. No.: 339,869

[22] Filed: Nov. 15, 1994

[51] Int. Cl.[6] ..... G03G 5/14

[52] U.S. Cl. ..... 430/63; 430/62

[58] Field of Search ..... 430/62, 63

[56] References Cited

U.S. PATENT DOCUMENTS

| | | | |
|---|---|---|---|
| 4,265,990 | 5/1981 | Stolka et al. | 430/59 |
| 4,402,593 | 9/1983 | Bernard et al. | 361/221 |
| 4,664,995 | 5/1987 | Horgan et al. | 430/59 |
| 4,988,597 | 1/1991 | Spiewak et al. | 430/62 |
| 5,063,125 | 11/1991 | Yuh et al. | 430/59 |
| 5,063,128 | 11/1991 | Yuh et al. | 430/63 |
| 5,096,795 | 3/1992 | Yu | 430/59 |
| 5,244,762 | 9/1993 | Spiewak et al. | 430/64 |

*Primary Examiner*—Roland Martin
*Attorney, Agent, or Firm*—Zosan S. Soong

[57] ABSTRACT

There is disclosed an electrostatographic imaging member comprising: (a) a supporting substrate including an electrically conductive surface; (b) at least one electrostatographic imaging layer; and (c) an electrically conductive grounding layer adjacent to the at least one imaging layer and in electrical contact with the electrically conductive surface, wherein the grounding layer is comprised of alkyl acrylamidoglycolate alkyl ether polymer.

14 Claims, 1 Drawing Sheet

IMAGE MEMBER INCLUDING A GROUNDING LAYER

BACKGROUND OF THE INVENTION

This invention relates generally to an imaging member including an electrically conductive grounding layer, and more specifically to an electrostatographic imaging member having an electrically conductive grounding layer comprised of alkyl acrylamidoglycolate alkyl ether polymer.

Photosensitive members having at least two electrically operative layers as disclosed in, for example, U.S. Pat. No. 4,265,990 provide excellent images when charged with a uniform negative electrostatic charge, exposed to a light image and thereafter developed with finely developed electroscopic marking particles. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Other electrostatographic imaging devices utilizing an imaging layer overlying a conductive layer include electrographic devices. For flexible electrographic imaging members, the conductive layer is normally sandwiched between a dielectric imaging layer and a supporting flexible substrate. Thus, flexible electrophotographic imaging members generally comprise a flexible recording substrate, a thin electrically conductive layer, and at least one photoconductive layer and electrographic imaging members generally comprise a conductive layer sandwiched between a dielectric imaging layer and a supporting flexible substrate. Both of these imaging members are species of electrostatographic imaging members.

In order to properly image an electrostatographic imaging member, the conductive layer must be brought into electrical contact with a source of fixed potential elsewhere in the imaging device. This electrical contact must be effective over many thousands of imaging cycles in automatic imaging devices. Since the conductive layer is frequently a thin vapor deposited metal, long life cannot be achieved with an ordinary electrical contact that rubs directly against the thin conductive layer. One approach to minimize the wear of the thin conductive layers is to use a grounding brush such as that described in U.S. Pat. No. 4,402,593. However, such an arrangement is generally not suitable for extended runs in copiers, duplicators and printers.

Still another approach to improving electrical contact between the thin conductive layer of flexible electrostatographic imaging members and a grounding means is the use of a relatively thick electrically conductive grounding strip layer in contact with the conductive layer and adjacent to one edge of the photoconductive or dielectric imaging layer.

Generally the grounding strip layer comprises opaque conductive particles dispersed in a film forming binder. This approach to grounding the thin conductive layer increases the overall life of the imaging layer because it is more durable than the thin conductive layer. However, such a relatively thick grounding strip layer is still subject to erosion which contributes to the formation of undesirable "dirt" in high volume imaging devices. Erosion is particularly severe in electrographic imaging systems utilizing metallic grounding brushes or sliding metal contacts.

Also, in systems utilizing a timing light in combination with a timing aperture in the grounding strip layer for controlling various functions of imaging devices, the erosion of the grounding strip layer by devices such as stainless steel grounding brushes and sliding metal contacts is frequently so severe that the grounding strip layer is worn away and becomes transparent thereby allowing light to pass through the grounding strip layer and creating false timing signals which in turn can cause the imaging device to prematurely shut down. Moreover, the opaque conductive particles formed during erosion of the grounding strip layer tends to drift and settle on other components of the machine such as the lens system, corotron, other electrical components, and the like to adversely affect machine performance. For example, at a relative humidity of 85 percent, the grounding strip layer life can be as low as 100,000 to 150,000 cycles in high quality electrophotographic imaging members. Also, due to the rapid erosion of the grounding strip layer, the electrical conductivity of the grounding strip layer can decline to unacceptable levels during extended cycling.

Thus, the characteristics of flexible electrostatographic imaging members utilizing conventional grounding strip layer exhibit deficiencies which are undesirable in automatic, cyclic electrostatographic imaging systems.

The following patents illustrate conventional imaging members including features such as a layer comprised of alkyl acrylamidoglycolate alkyl ether polymer or a grounding strip layer: Yu, U.S. Pat. Nos. 5,096,795; Yuh et al., 5,063,125; Horgan et al., 4,664,995; Yuh et al., 5,063,128; Spiewak et al., 5,244,762; and Spiewak et al., 4,988,597, the disclosures of which are totally incorporated by reference.

SUMMARY OF THE INVENTION

It is an object in embodiments of the instant invention to provide an electrostatographic imaging member which resists erosion (i.e., increase wear resistance, and/or exhibits good adhesion of the grounding layer to other contiguous layer(s).

These objects and others are accomplished in embodiments by providing an electrostatographic imaging member comprising:

(a) a supporting substrate including an electrically conductive surface;

(b) at least one electrostatographic imaging layer; and (c) an electrically conductive grounding layer adjacent to the at least one imaging layer and in electrical contact with the electrically conductive surface, wherein the grounding layer is comprised of alkyl acrylamidoglycolate alkyl ether polymer.

BRIEF DESCRIPTION OF THE DRAWINGS

Other aspects of the present invention will become apparent as the following description proceeds and upon reference to FIG. 1 which represents a preferred embodiment.

DETAILED DESCRIPTION

Figure 1:
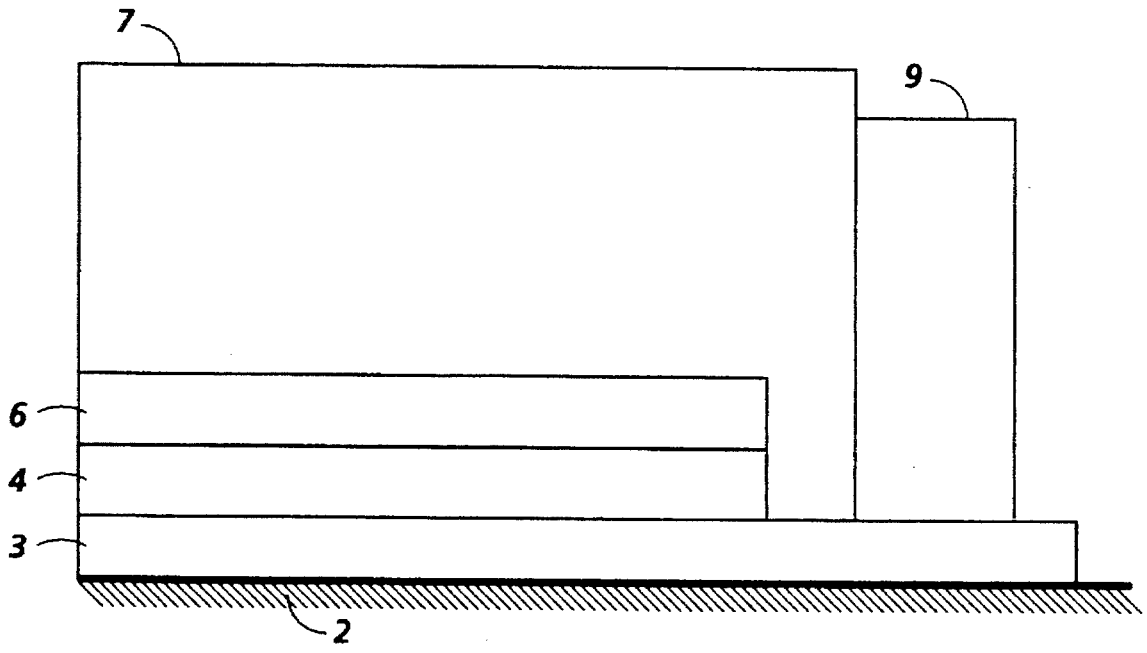
FIG. 1 illustrates a cross-sectional view of a multi-layer photoreceptor of the instant invention.

A representative structure of an electrostatographic imaging member is shown in FIG. 1. This imaging member is provided with a supporting substrate 2, an electrically conductive ground plane 3, a blocking layer 4, a charge generating layer 6, a charge transport layer 7, and a grounding layer 9 adjacent to the other layers wherein the grounding layer 9 may be in the form of a strip disposed along an edge portion of the imaging member.

The grounding layer may be in electrical contact (such as by direct physical contact) with one, two, three or more of the other layers. For example, in FIG. 1, the grounding layer 9 is preferably in electrical contact with only the ground plane 3 and the charge transport layer 7, whereby the charge transport layer 7 may cover a side edge of several other layers including for instance the charge generating layer 6 and the blocking layer 4. In embodiments of the instant invention, the grounding layer may be in electrical contact with the charge transport layer, the charge generating layer, and the ground plane. In embodiments, the deposition of the grounding layer 9 adjacent to one or more of the other layers may minimize delamination of the imaging member during cycling inside a copying or printing apparatus (where delamination may result from repeated contact with for example a cleaning blade) since the grounding layer covers the interface between adjacent layers. The grounding layer may be formed subsequent to deposition of the charge transport layer so as to provide grounding contact with a grounding device (not shown) during electrostatographic processes.

The various layers of the imaging member may be applied by any known photoreceptor fabricating technique. Typical coating techniques include for example solvent coating, extrusion coating, spray coating, dip coating, lamination, solution spin coating, and the like. Further, the coating solutions can be used with seamless organic photoreceptor belt processes. The coated solutions may be dried by conventional drying techniques such as oven drying, forced air drying, circulating air oven drying, radiant heat drying, and the like.

A description of suitable materials for the electrostatographic imaging member of the instant invention follows.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be flexible and may have any number of different configurations such as, for example, a sheet, a scroll, an endless flexible belt, and the like. Preferably, the substrate is in the form of an endless flexible belt and comprises a commercially available biaxially oriented polyester known as MYLAR™, available from E. I. du Pont de Nemours & Co., or MELINEX™, available from ICI Americas Inc.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission. Regardless of the technique employed to form the metal layer, a thin layer of metal oxide may form on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Blocking Layer

After deposition of the electrically conductive ground plane layer, the blocking layer 4 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is the 30 mole percent benzoate ester of poly(2-hydroxyethyl methacrylate) blended with the parent polymer poly(2-hydroxyethyl methacrylate). Still other suitable hole blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly-(methyl acrylamidoglycolate methyl ether-co-2-hydroxyethyl methacrylate). The disclosures of U.S. Pat. Nos. 5,244,762 and 4,988,597 are incorporated herein by reference in their entirety.

The blocking layer is continuous and may have a thickness of less than about 10 micrometers because greater thicknesses may lead to undesirably high residual voltage. A hole blocking layer of between about 0.005 micrometer and about 1.5 micrometers is preferred because charge neutralization after the exposure step is facilitated and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 5:100 is satisfactory for spray coating.

The Adhesive Layer

Intermediate layers between the blocking layer and the adjacent charge generating or photogenerating layer may be desired to promote adhesion. For example, the adhesive layer (not shown) may be employed. If such layers are utilized, they preferably have a dry thickness between about 0.001 micrometer to about 0.2 micrometer. Typical adhesive layers include film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like.

The Imaging Layer(s)

The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium-arsenic, selenium-tellurium, selenium-arsenic-antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generating layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and U.S. Pat. No. 4,439,507. The disclosures of these patents are incorporated herein by reference in their entirety.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. Nos. 3,121,006 and 4,439,507, the disclosures of which are totally incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present for example in an amount of at least about 15 percent by volume of the binder layer with no limit on the maximum amount of photoconductor in the binder layer. If the matrix or binder comprises an active material, e.g. poly-N-vinylcarbazole, the photoconductive material need only to comprise for example about 1 percent or less by volume of the binder layer with no limitation on the maximum amount of photoconductor in the binder layer. Generally for charge generator layers containing an electrically active matrix or binder such as poly-N-vinyl carbazole or phenoxy [poly(hydroxyether)], from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder. The specific proportions selected also depends to some extent on the thickness of the generating layer.

The thickness of the photogenerating binder layer is not particularly critical. Layer thicknesses from about 0.05 micrometer to about 40.0 micrometers may be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photo-generated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generating layer is a material which is an insulator to the extent that an electrostatic charge placed on the transport layer is not conductive in the absence of illumination, i.e., does not discharge at a rate sufficient to prevent the formation and retention of an electrostatic latent image thereon.

An especially preferred transport layer employed in one of the two electrically operative layers in the multilayer photoconductor embodiment of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines for charge transport layers capable of supporting the injection of photogenerated holes of a charge generating layer and transporting the holes through the charge transport layer include triphenylmethane, bis(4-diethylamine-2-methylphenyl) phenylmethane; 4'-4"-bis(diethylamino)-2',2"dimethyltriphenyl-methane, N,N'-bis(alkylphenyl)-[1,1'-biphenyl]-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as LEXAN 145™ from General Electric Company; poly(4,4'-isopropylidene-diphenylene carbonate) with a molecular weight of from about 40,000 to about 45,000, available as LEXAN 141™ from the General Electric Company; a polycarbonate resin having a molecular weight of from about 50,000 to about 100,000, available as MAKROLON™ from Farbenfabricken Bayer A. G., a polycarbonate resin having a molecular weight of from about 20,000 to about 50,000 available as MERLON™ from Mobay Chemical Company and poly(4,4'-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat. Nos. 4,806,443; 4,806,444; and 4,818,650, the disclosures thereof being totally incorporated herein by reference.

Any suitable and conventional technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the transport layer is between about 5 micrometers to about 100 micrometers, but thicknesses outside this range can also be used. In general, the ratio of the thickness of the charge transport layer to the charge generating layer is preferably maintained from about 2:1 to 200:1 and in some instances as great as 400:1.

The Grounding Layer

The grounding layer may comprise for instance a first film forming polymer like an alkyl acrylamidoglycolate alkyl ether polymer, a second polymer which may enhance the mechanical properties of the grounding layer, and electrically conductive particles.

Homopolymers and copolymers of methyl acrylamidoglycolate alkyl ether are especially preferred as binders because the polymers have the desired crosslinking capability, which may enhance for example adhesion of the grounding layer to a contiguous layer. Copolymers of methyl acrylamidoglycolate alkyl ether and units with basic groups, such as N,N-dimethylacrylamide, N-vinylpyrrolidone, 2- and 4-vinylpyridine are especially preferred because the copolymers have the desired basic property and the preferred crosslinking capability. Other copolymers preferably comprise methyl acrylamidoglycolate alkyl ether and vinyl monomers. Polymers such as copolymers of methyl acrylamidoglycolate alkyl ether will cross-link together upon heating. Typical copolymerizable vinyl monomers include acrylonitrile, methacrylonitrile, methylvinylether, and other alkyl and aryl vinyl ethers, styrene and substituted styrenes, ethylene, propylene, isobutylene, various methacrylate and acrylate esters and vinyl chloride, and the like. Other monomers, such as vinyl acetate and methyl methacrylate, can be copolymerized with methyl acrylamidoglycolate alkyl ether in order to enhance adhesion or flexibility. Some monomers that undergo vinyl-like polymerizations that are not vinyl monomers may also copolymerize with alkyl acrylamidoglycolate alkyl ether.

The cross-linking capability of the alkyl acrylamidoglycolate alkyl ether polymer imparts enhanced chemical stability to the dried grounding layer. Cross-linking may protect the dried grounding layer from being physically removed or attacked by subsequently applied solvents and ambient humidity. The degree of cross-linking can be adjusted by varying the repeat unit ratio of the unit capable of cross-linking, the acid catalyst doping level, the heating time and heating temperature. Thus, for example, partial crosslinking can be achieved by heating the grounding layer at lower drying temperatures. The degree of crosslinking desired is determined by the adhesion and flexibility requirements of the complete devices. For example, partial crosslinking can provide an opportunity for further bonding to material in contiguous layers by heating the device with the contiguous layers at the temperature high enough for a condensation reaction to occur. This increases the adhesion between the grounding layer and the contiguous layer or layers. In embodiments of the instant invention, the alkyl acrylamidoglycolate alkyl ether polymer in the grounding layer is preferably crosslinked with the electrically conductive surface of the supporting substrate, and more preferably crosslinked with the electrically conductive surface of the supporting substrate and at least one imaging layer such as the charge transport layer and/or charge generating layer.

The alkyl acrylamidoglycolate alkyl ether utilized in preparing the backbone of a preferred polymer employed in the grounding layer of photoreceptors of this invention can be represented by the following formula:

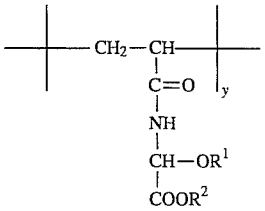

where $R^1$ and $R^2$ are independently selected from lower aliphatic groups containing from 1 to 10 carbon atom; and y ranges from about 20 to about 6,000.

Preferably, $R^1$ and $R^2$ contain from 1 to 4 carbon atoms with optimum results being achieved when $R^1$ and $R^2$ are methyl groups. Typical alkyl acrylamidoglycolate alkyl ethers include, for example, methyl acrylamidoglycolate methyl ether, butyl acrylamidoglycolate methyl ether, methyl acrylamidoglycolate butyl ether, butyl acrylamidoglycolate butyl ether, and the like.

A polymer derived from alkyl acrylamidoglycolate alkyl ether may be a homopolymer or a copolymer, the copolymer being a copolymer of two or more monomers. The alkyl acrylamidoglycolate alkyl ether monomer may be formed into a linear polymer by polymerization through the unsaturated bond. The monomers utilized to form a copolymer with the alkyl acrylamidoglycolate alkyl ether need not contain hydroxyl groups. Blends of the polymer or copolymer with other miscible polymers or copolymers may also be utilized.

Since the aikyl acrylamidoglycolate alkyl ether polymer for the grounding layer can be applied as an uncross-linked polymer dissolved in a solvent, it may be cross-linked in an oven without the aid of a catalyst and, therefore, can be free of any pot life problem or catalytic residue problem. When alkyl acrylamidoglycolate alkyl ether is used as a homopolymer, it may be cross-linked without the presence of any other materials. Crosslinking of this homopolymer may be achieved through the $R^1$ and $R^2$ groups. Satisfactory results may be achieved when the number average molecular weight for the linear homopolymer is at least about 2,000 if the polymer is eventually cross-linked. Preferably, the homopolymer has a number average molecular weight of at least 20,000 with optimum results being achieved with a number average molecular weight of at least about 50,000 prior to cross-linking. If the homopolymer is to remain a linear polymer in the final dried coating, satisfactory results may be achieved with a number average molecular weight of at least about 20,000. Preferably the number average molecular weight is at least about 50,000 and optimum results are achieved with a number average molecular weight of at least 100,000 if the polymer is to remain an uncross-linked linear polymer.

Up to 99 mole percent of any suitable vinyl monomer may be copolymerized with the alkyl acrylamidoglycolate alkyl ether monomer to form a copolymer binder in the grounding layer of this invention. Typical vinyl monomers include, for example, vinyl chloride, vinyl acetate, styrene, acrylonitrile, N,N-dimethylacrylamide, 2-hydroxyethyl acrylate, 2-hydroxyethyl methacrylate, 2-hydroxypropyl acrylate, 2-hydroxypropyl methacrylate, N-hydroxymethylacrylamide, N-hydroxymethylmethacrylamide, 2-vinylpyridine, 4-vinylpyridine, N-vinylpyrrolidone, methyl methacrylate, and the like.

The preferred alkyl acrylamidoglycolate alkyl ether is methyl acrylamidoglycolate methyl ether which can be represented by the following formula:

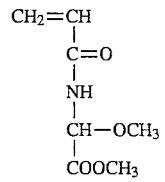

The methyl acrylamidoglycolate methyl ether monomer is commercially available, for example, from American Cyanamid under the trademark MAGME™. It is described in American Cyanamid Co. product brochure 4-211-3K as copolymerizable with various other vinyl type monomers. It is also indicated in the brochure that the most likely crosslinking chemical pathways are a function of heating and/or acid catalysis with heating. Methyl acrylamidoglycolate methyl ether monomer is a multi-functional acrylic monomer which, after undergoing a standard vinyl polymerization by itself or with other vinyl monomers to form a linear polymer, provides chemically reactive sites that can be cross-linked by several chemical routes. Cross-linking of the alkyl acrylamidoglycolate alkyl ether homopolymer may be achieved through the $R^1$ and $R^2$ groups. The alkyl ester and alkyl ether reactive sites in the alkyl acrylamidoglycolate alkyl ether repeat units of alkyl acrylamidoglycolate alkyl ether containing polymers can also be reacted with difunctional nucleophiles such as diamines and dialcohols to give a covalently cross-linked polymer network. Such a cross-linked binder can encapsulate and permanently anchor conductive particles such as carbon black. Subsequently applied coating compositions in various solvents or solvent combinations are incapable of dislodging these particles. Deleterious electrical effects (low charge acceptance, high dark decay and high residual voltage) usually caused by migration of conductive particles are minimized by preventing the upward migration of conductive particles into other layers of the photoreceptor. In all these nucleophilic displacement reactions on alkyl acrylamidoglycolate alkyl ether repeat units in alkyl acrylamidoglycolate alkyl ether containing polymers, an alkanol is evolved. Volatile alcohol by-products such as methanol from methylacrylamido-glycolate methyl ether repeat units are evolved and leave the coating because the reactions are carried out at about 135° C., well over the boiling point (65° C.) of methanol.

A preferred vinyl monomer copolymerizable with the alkyl acrylamidoglycolate alkyl ether is a vinyl hydroxy ester or vinyl hydroxy amide having the following structure:

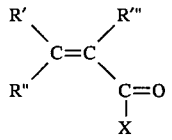

wherein

X is selected from the group consisting of:

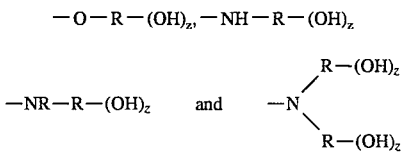

R is a divalent group selected from the group consisting of aliphatic, aromatic, heteroaliphatic, heteroaromatic, fused aromatic ring and heteroaromatic ring groups containing up to 10 carbon atoms;

z is 1 to 10; and

R', R" and R"' are are monovalent groups independently selected from the group consisting of hydrogen, lower aliphatic containing up to 10 carbon atoms and aromatic, heteroaliphatic, heteroaromatic, fused aromatic ring and heteroaromatic ring groups containing up to 10 carbon atoms.

Typical divalent R aliphatic groups include methylene, ethylidene, propylidene, isopropylidene, butylene, isobutylene, decamethylene, phenylene, biphenylene, piperadinylene, tetrahydrofuranylene, pyranylene, piperazinylene, pyridylene, bipyridylene, pyridazinylene, pyrimidinylene, naphthylidene, quinolinyldene, cyclohexylene, cyclopentylene, cyclobutylene, cycloheptylene, and the like.

Typical monovalent R', R" and R"' groups include hydrogen, methyl, ethyl, propyl, isopropyl, butyl, isobutyl, decyl, phenyl, biphenyl, piperadinyl, tetrahydrofuranyl, pyranyl, piperazinyl, pyridyl, bipyridyl, pyridazinyl, naphthyl, quinolinyl, cyclohexyl, cyclopentyl, cyclobutyl, cycloheptyl, and the like.

Typical aliphatic, aromatic, heteroaliphatic, heteroaromatic, fused aromatic ring and heteroaromatic ring groups containing up to 10 carbon atoms include linear, single ring and multiple ring, fused and unfused groups such as naphthalene, thiophene, quinoline, pyridine, toluene, furan, pyrrole, isoquinoline, benzene, pyrazine, pyrimidine, bipyridine, pyridazine, and the like.

The copolymer having a backbone derived from alkyl acrylamidoglycolate alkyl ether may be a copolymer of 2 or more different monomers or polymer blocks. Copolymers of alkyl acrylamidoglycolate alkyl ether and vinyl hydroxy ester or vinyl hydroxy amide monomers are particularly preferred because they are non-ionic and neutral and chemically innocuous and do not adversely affect the electrically properties of the photoreceptor. If desired, the copolymer of alkyl acrylamidoglycolate alkyl ether monomer and vinyl hydroxy ester or vinyl hydroxy amide monomer may also be co-reacted with any other suitable reactive monomer. More basic solvent, either through quantity or basicity, can be used in order to impart sufficient basicity to the polymer solution. If desired, the copolymer of aikyl acrylamidoglycolate alkyl ether monomer and vinyl hydroxy ester or vinyl hydroxy amide monomer may also be coreacted with any other suitable reactive monomer.

The copolymer having a backbone derived from alkyl acrylamidoglycolate alkyl ether and a vinyl hydroxy ester or vinyl hydroxy amide may be a copolymer, a terpolymer or the the like. Moreover, the copolymer may be a random copolymer or a block copolymer. A preferred copolymer in linear form prior to cross-linking is represented by the following formula:

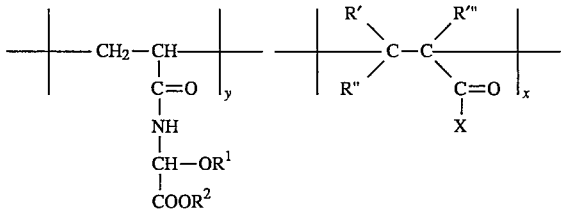

wherein:

$R^1$ and $R^2$ are independently selected from alkyl groups containing from 1 to 4 carbon atoms, y is from 100 mol percent to 1 mol percent, x is from 0 mol percent to 99 mol percent, X is selected from the group consisting of groups represented by the following groups:

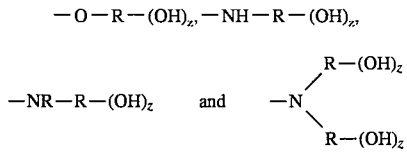

R is selected from the group consisting of aliphatic, aromatic, heteroaliphatic, heteroaromatic, fused aromatic ring and heteroaromatic ring groups containing up to 10 carbon atoms;

z contains from 1 to 10 hydroxyl groups;

R', R" and R"' are independently selected from the group consisting of hydrogen, aliphatic, aromatic, heteroaliphatic, heteroaromatic, fused aromatic ring and heteroaromatic ring groups containing up to 10 carbon atoms.

Generally, satisfactory results may be achieved when x is between about 0 and about 99 mol percent and y is between about 100 and about 1 mol percent. Preferably y is between about 33 and about 90 mol percent and x between about 67 and about 10 mol percent. Optimum results are achieved when y is between about 33 and about 67 mol percent and x is between about 67 and about 33 mol percent. If desired, the alkyl acrylamidoglycolate alkyl ether of this invention may be employed as a homopolymer instead of a copolymer. This homopolymer may be crosslinked without the presence of any other materials.

Satisfactory results may be achieved when the number average molecular weight for the linear homopolymer or copolymer is at least about 2,000 if the polymer is eventually cross-linked in the deposited coating. Preferably, the homopolymer or copolymer has a number average molecular weight of at least 20,000 with optimum results being achieved with a number average molecular weight of at least about 50,000 prior to cross-linking. The upper limit for number average molecular weight appears to be limited only by the viscosity necessary for processing.

If the homopolymer or copolymer is to remain a linear polymer in the dried grounding layer, satisfactory results may be achieved with a number average molecular weight of at least about 10,000. Preferably the number average molecular weight should be at least about 20,000 and optimum results may be achieved with a number average molecular weight of at least 50,000 if the polymer is to remain an uncross-linked linear polymer.

Other typical copolymers having a backbone derived from methyl acrylamidoglycolate methyl ether (MAGME) and 2-hydroxyethylmethacrylate (HEMA) are represented by the following formula:

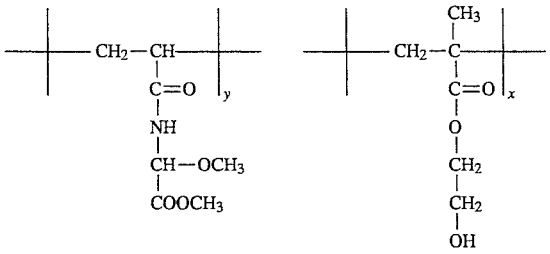

wherein:

y is from 100 mol percent to 1 mol percent and x is from 0 mol percent to 99 mol percent.

Another preferred polymer is one having a backbone derived from methyl acrylamidoglycolate methyl ether and 2-hydroxypropylmethacrylate (HPMA) represented by the following formula:

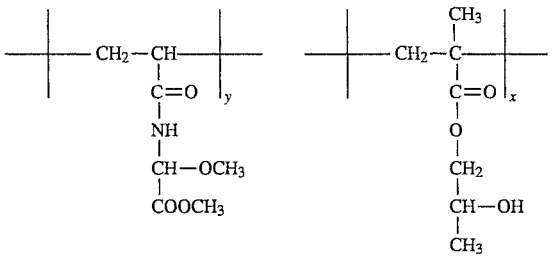

wherein:

y is from 100 mol percent to 1 mol percent and x is from 0 mol percent to 99 mol percent.

Still another preferred polymer is one having a backbone derived from methyl acrylamidoglycolate alkyl ether and 2-hydroxyethylacrylate (HEA) which is represented by the following formula:

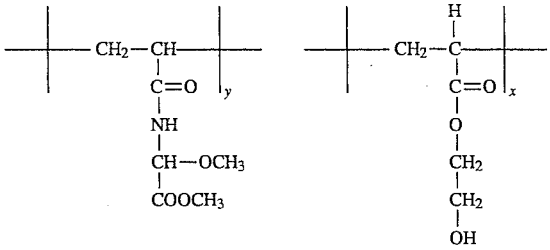

wherein:

y is from 100 mol percent to 1 mol percent and x is from 0 mol percent to 99 mol percent.

Still another preferred polymer is one having a backbone derived from methyl acrylamidoglycolate methyl ether and 2-hydroxypropylacrylate which is represented by the following formula:

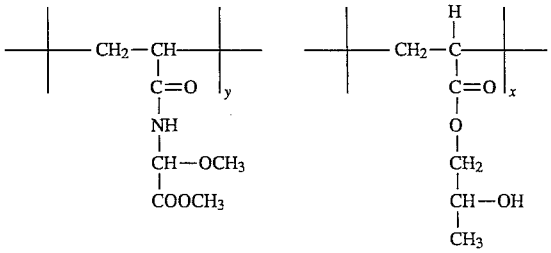

wherein:

y is from 100 mol percent to 1 mol percent and x is from 0 mol percent to 99 mol percent.

Cross-linking of the alkyl acrylamidoglycolate alkyl ether polymer of the grounding layer with a contiguous layer or layers may be facilitated when the contiguous layer or layers contain hydroxyl functional groups or the same or similar alkyl acrylamidoglycolate alkyl ether polymer. For example, the ground plane, especially those containing metal, may have a naturally formed oxide layer on the surface. The oxide layer generally absorbs moisture and can be converted partially to hydroxyl functional groups. Immersion of the layer in water doped with low level of acid or base can make the conversion more completely. Also, a ground plane which is comprised of a polymeric binder with hydroxyl groups can be reacted to the alkyl acrylamidoglycolate alkyl ether polymer of the grounding layer. Cross-linking between the grounding layer and the ground plane and other contiguous layers such as the charge transport layer can be promoted by providing the ground plane and the contiguous layers with the same or similar alkyl acrylamidoglycolate alkyl ether polymer as in the grounding layer, thereby enhancing adhesion between the various layers. The strong adhesion of the grounding layer to for example the ground plane and optionally the charge transport layer may protect weak interfaces in the imaging member, especially with a seamless drum or belt structure.

Cross-linking of the alkyl acrylamidoglycolate alkyl ether polymer of the grounding layer with a contiguous layer or layers can occur by two chemical routes. As an illustration of one chemical route, methyl acrylamidoglycolate methyl ether units in one copolymer chain of one layer can self condense with methyl acrylamidoglycolate methyl ether units in a second polymer chain of a second layer or surface to give a complex methylene bis amide cross-link illustrated below:

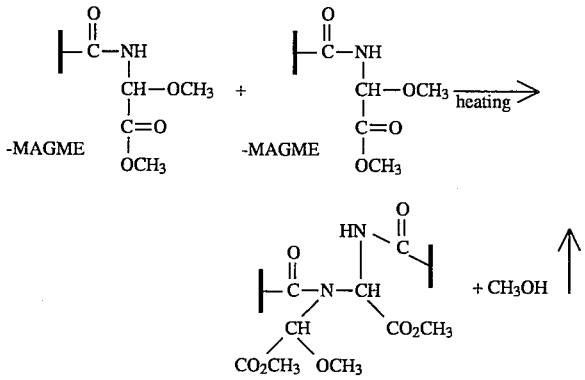

This cross-linking pathway is believed to be a minor pathway because this chemical reaction takes place slowly at 135° C. in the absence of an acid catalysis. However, when acid catalysis is employed, this pathway becomes more important. Since migration of the small molecule acid species (p-toluenesulfonic acid) into other layers (during coating thereof) can cause deleterious electrical effects, cross-linking of these layers without acid catalysis is preferred with cross-linking being accomplished by merely applying heat while simultaneously removing the coating solvent in, for example, an air convection oven. Thus, the chemical reaction depicted above remains a minor cross-linking pathway, leaving the bulk of the methylacrylamido-glycolate methyl ether repeat units available to participate in the second cross-linking pathway which is less dependent on acid catalysis at 135° C.

The second cross-linking pathway is shown below:

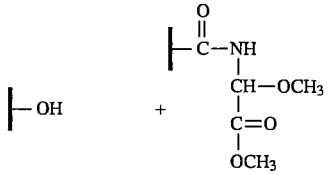

HYDROXYL GROUP OF PENDANT ESTER OR AMIDE COPOLYMER REPEAT UNIT IN FIRST LAYER

-MAGME REPEAT UNIT IN SECOND LAYER CONTIGUOUS WITH THE FIRST LAYER

-continued

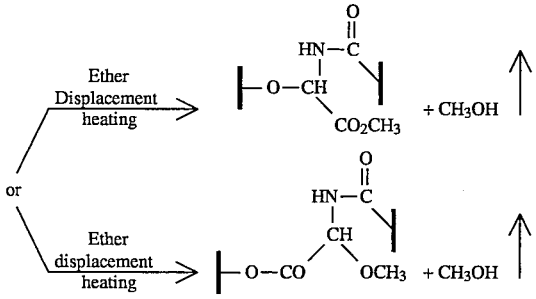

In this second cross-linking pathway, hydroxyl groups from one copolymer displace both the ether and ester methoxyl groups of another copolymer to give the corresponding ether and ester cross-links. This reaction proceeds rapidly at 135° C. even without acid catalysis.

The alkyl acrylamidoglycolate alkyl ether polymer may be present in the grounding layer in any suitable amount ranging for example from about 10 to about 60% by weight of the grounding layer, and preferably from about 20 to about 40% by weight of the grounding layer.

Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive grounding layer having an excessively irregular outer surface. An average particle size of less than about 10 micrometers generally avoids excessive protrusion of the electrically conductive particles at the outer surface of the dried grounding layer and ensures relatively uniform dispersion of the particles throughout the matrix of the dried grounding layer. The concentration of the conductive particles to be used in the grounding layer depends on factors such as the conductivity of the specific conductive particles utilized.

The grounding layer may have a thickness from about 7 micrometers to about 42 micrometers, and preferably from about 14 micrometers to about 27 micrometers.

The second polymer may be selected to impart one or more of the following properties to the grounding layer: abrasion resistance, mechanical strength, and flexibility. Examples of the second polymer included in the grounding layer include polymers containing repeat units common to the polymers contacting or contiguous with the grounding layer in order to obtain maximum interfacial adhesion of the grounding layer to that contiguous layer. Specific examples of polycarbonates include poly(oxycarbonyloxy-1,4-phenyleneisopropylidene- 1,4-phenylene) and poly(oxycarbonyloxy-1,4-phenylenecyclohexylidene- 1,4-phenylene). Examples of ester containing resins include copolyester or polyesters containing ether groups. Specific examples include the Goodyear VITEL™ resins and adhesive copolyester resins such as PE-49000. Other examples of ester containing polymers include poly(oxyethyleneoxyadipoyl), poly(oxyadipoyloxydecamethylene), poly(oxyadipoyloxy-1,4-phenyleneisopropylidene-1,4-phenylene), and poly-(di(oxyethylene)oxyglutaryl). Other examples of acrylic esters include poly(2-ethylhexyl methacrylate), poly(2-dimethylaminoethyl methacrylate) and poly(2-ethoxyethyl methacrylate). Specific examples of polymers containing styrene include poly(4-butylstyrene), poly(4-ethoxystyrene), and poly(4-ethoxycarbonylstyrene). The second polymer may be present in the grounding layer in any suitable amount ranging for example from about 10 to about 60% by weight of the grounding layer, and preferably from about 20 to about 40% by weight of the grounding layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

A grounding layer was prepared as follows. A dispersion of 5.72% by weight solids content in methylene chloride solvent was prepared. The solids content of the dispersion comprised the following: 64% by weight MAKROLON™ (a polycarbonate); 16% by weight additive (described below); and 20% by weight carbon black CD-975 ULTRA™ available from Columbian Chemical Company. The additive was a copolymer of MAGME™-vinyl acetate (50–50 mole percent). The dispersion was prepared as follows: dissolved 6.5 g MAKROLON™ and 1.625 g additive in 167 g methylene chloride in a 16 ounce bottle; added 2 g carbon black CD-975 ULTRA™ and 350 g steel shots (440C available from Hoover Group, Inc.). The 440C steel shots were cleaned before use by first being rolled in methylene chloride for two hours to remove the grease, then dried in an oven. The 16 ounce bottle was then rolled on a roll mill for over a week. The dispersed carbon black particles were all less than one micron in size. The dispersion was then coated onto a ground plane (prepared as described below) with a draw bar of 3 rail opening. The coating was dried from room temperature (about 25° C.) to about 110° C. in an hour and the temperature stayed at 110° C. for an additional 30 minutes to result in the grounding layer. The dried coating containing the copolymer of MAGMET™-vinyl acetate (i.e, the grounding layer) exhibited good adhesion to the ground plane. The adhesion between the ground plane and grounding layer was greater than 200 g/cm, as measured by an Instron instrument. The Instron instrument measured the amount of forces needed to apply on a 1 cm wide strip of the device in order to separate the layers of the device.

The ground plane comprised: 20% by weight carbon black CD-975 ULTRA™; 16.3% by weight N,N'-diphenyl-N,N'-bis(3-hydroxyphenyl)-(1,1'-biphenyl)-4,4'-diamine; 54.1% by weight MAGME™-vinyl pyrrolidone (33–67 mole percent); and 9.6% by weight MAGME™-vinyl acetate (50—50 mole percent). The ground plane was prepared as follows. About 1.029 g of the copolymer of MAGMET™-vinyl pyrrolidone (33–67 mole percent) and about 1.029 g of the copolymer of MAGME™-vinyl acetate (50—50 mole percent) was dissolved into a solvent mixture of 10 g dimethylformamide and 5 g DOWANOL PM™. To this solution, 0.51 g N,N'-diphenyl-N,N'-bis(3-hydroxyphenyl)-(1,1'-biphenyl)-4,4'-diamine was added. After dissolution of the diamine compound, 0.54 g carbon black (CD-975 ULTRA™) and 70 g of one-eighth inch steel shot were added. The mixture was then shaken in a paint shaker for 1½ hours. The dispersion was then coated onto a corona treated polyethylene terephthalate sheet with a number 14 Meyer rod. The coating was dried at 135° C. for 1½ hours. The dried thickness of the ground plane is approximately 1 micron.

EXAMPLE 2

The same procedures as described in Example 1 were used to prepare the grounding layer except that the additive was MAGME™-vinyl pyrrolidone (33–67 mole percent) instead of MAGME™-vinyl acetate (50–50 mole percent). The dried coating containing the copolymer of MAGME™-vinyl pyrrolidone (i.e, the grounding layer) exhibited good adhesion to the ground plane. The grounding layer including MAGME™-vinyl pyrrolidone had a resistivity in the order of 103 ohms/sq. The resistivity was measured by a conventional four-point probe resistivity measurement arrangement.

The same procedures as described in Example 1 were used to prepare the ground plane.

EXAMPLE 3

A grounding layer was prepared as follows. A dispersion containing MAKROLON™; MAGME™-vinyl pyrrolidone, and carbon black CD-975 ULTRA™ in methylene chloride was prepared using the same procedures described in Example 2. Fifty-two grams of the dispersion were diluted with about 20 to about 40 grams of 1,1,2-trichloroethane and were spray coated onto a photoreceptor belt with a Binks Model C air brush spray gun with a fan angle setting of HN-3. The spray coating, i.e., the grounding layer, was dried at 130° C. for one hour. The photoreceptor belt comprised the following layers in the recited order: a substrate of corona treated injection/blow molded poly(ethylene terephthalate); a ground plane as provided in Example 2; a charge generating layer of selenium dispersed in a polyvinyl butyral binder; a charge transport layer of N,N'-diphenyl-N,N'-bis(3-methylphenyl)-[1,1'-biphenyl]-4,4'-diamine/MERLON™. The resulting thicknesses of each layer were 20 micrometers for the charge transport layer, 0.5 micrometer for the charge generating layer, 0.5 micrometer for the ground plane and 1 micrometer for the grounding layer. The photoreceptor belt with the grounding layer was cycled in a three roll (roll diameter ¾ inch) belt test fixture. The testing was terminating after cycling of 450,000 cycles with no observation of edge delamination on the side of the belt. No cracking of the grounding layer was visually detected.

Other modifications of the present invention may occur to those skilled in the art based upon a reading of the present disclosure and these modifications are intended to be included within the scope of the present invention.

We claim:

1. An electrostatographic imaging member comprising:

(a) a supporting substrate including an electrically conductive surface;

(b) a charge generating layer;

(c) a charge transport layer; and (d) an electrically conductive grounding layer in contact with the conductive surface of the substrate and the charge transport layer, wherein the grounding layer comprises electrically conductive particles; alkyl acrylamidoglycolate alkyl ether polymer which is interfacially bonded with the conductive surface of the substrate, thereby improving adhesion between the grounding layer and the substrate conductive surface; and a second polymer which is interfacially bonded with the charge transport layer, thereby improving adhesion between the grounding layer and the transport layer.

2. The imaging member of claim 1, wherein the electrically conductive surface is a ground plane formed on the substrate.

3. The imaging member of claim 1, wherein the substrate is electrically conductive.

4. The imaging member of claim 1, further comprising a charge blocking layer disposed between the electrically conductive surface and the charge generating layer.

5. The imaging member of claim 1, wherein the grounding layer is in contact only with the charge transport layer and the electrically conductive surface.

6. The imaging member of claim 1, wherein the grounding layer is in the form of a strip disposed along an edge portion of the substrate.

7. The imaging member of claim 1, wherein the alkyl acrylamidoglycolate alkyl ether polymer is a homopolymer.

8. The imaging member of claim 1, wherein the alkyl acrylamidoglycolate alkyl ether polymer is a copolymer.

9. The imaging member of claim 1, wherein the alkyl acrylamidoglycolate alkyl ether polymer is a copolymer comprised of methyl acrylamidoglycolate methyl ether and vinyl pyrrolidone.

10. The imaging member of claim 1, wherein the alkyl acrylamidoglycolate alkyl ether polymer is a copolymer comprised of methyl acrylamidoglycolate methyl ether and vinyl acetate.

11. The imaging member of claim 1, wherein the alkyl acrylamidoglycolate alkyl ether polymer is poly (methyl acrylamidoglycolate methyl ether).

12. The imaging member of claim 1, wherein the alkyl acrylamidoglycolate alkyl ether polymer is interfacially bonded with the electrically conductive surface and the charge transport layer.

13. The imaging member of claim 1, wherein the alkyl acrylamidoglycolate alkyl ether polymer is a copolymer including a vinyl compound.

14. The imaging member of claim 1, wherein the second polymer is selected from the group consisting of a polycarbonate and a polyester.

* * * * *